US012648658B2

(12) United States Patent
Thompson et al.

(10) Patent No.: US 12,648,658 B2
(45) Date of Patent: Jun. 9, 2026

(54) MULTI-PURPOSE INFINITY TRAVEL PILLOW

(71) Applicant: Frustration Free Solutions, LLC, Twin Falls, ID (US)

(72) Inventors: Nathan Thompson, Twin Falls, ID (US); Jimmy Morrison, Springville, UT (US)

(73) Assignee: Frustration Free Solutions, LLC, Twin Falls, ID (US)

( * ) Notice: Subject to any disclaimer, the term of this patent is extended or adjusted under 35 U.S.C. 154(b) by 784 days.

(21) Appl. No.: 17/736,528

(22) Filed: May 4, 2022

(65) Prior Publication Data

US 2022/0354281 A1 Nov. 10, 2022

Related U.S. Application Data

(60) Provisional application No. 63/183,962, filed on May 4, 2021.

(51) Int. Cl.
*A47G 9/10* (2006.01)
*A47G 9/02* (2006.01)

(52) U.S. Cl.
CPC ..... *A47G 9/1045* (2013.01); *A47G 9/0223* (2013.01)

(58) Field of Classification Search
CPC .... A47G 9/1045; A47G 9/0223; A47G 9/282; A47G 9/0253; A47G 9/066; A47G 9/06; A47G 9/064; A47C 16/00; A47C 7/383
See application file for complete search history.

(56) References Cited

U.S. PATENT DOCUMENTS 5,313,678 A * 5/1994 Redewill ..... H04R 5/023 5/639
6,408,462 B1 * 6/2002 Moore ..... A45F 4/02 2/84
8,127,382 B1 * 3/2012 Plascencia ..... A47G 9/1045 5/639
11,033,129 B2 * 6/2021 Diaz ..... A42B 1/006
2001/0044964 A1 * 11/2001 Phillips ..... A47G 9/064 5/485

(Continued)

OTHER PUBLICATIONS

Hodakel, Boris. (Oct. 30, 2020). What is Corduroy Fabric: Properties, How its Made and Where. Sewport. https://web.archive.org/web/20201030081133/https://sewport.com/fabrics-directory/corduroy-fabric (Year: 2020).*

(Continued)

*Primary Examiner* — Matthew Troutman
*Assistant Examiner* — Alison N Labarge
(74) *Attorney, Agent, or Firm* — Dentons Durham Jones Pinegar

(57) ABSTRACT

A travel pillow system includes an outer sleeve with a first end reversibly connectable to a second end. The outer sleeve may be stuffed or filled with a blanket to form an infinity scarf or neck pillow that may be used in a variety of configurations to support the neck, head, back, shoulders, etc., and also be used as a light-blocking pillow. The sleeve may be provided with a pocket for holding items such as ID cards, keys, credit cards, and other travel essentials. A pillowcase may also be provided and the blanket may be removed from the outer sleeve and used to fill the pillowcase. The blanket may also be secured around a user and include pockets for a user's hands.

17 Claims, 12 Drawing Sheets

(56) References Cited

U.S. PATENT DOCUMENTS

| | | | | |
|---|---|---|---|---|
| 2004/0237196 | A1 | 12/2004 | Booth | |
| 2008/0172792 | A1* | 7/2008 | Dreessen | A47G 9/1045 5/636 |
| 2014/0007351 | A1* | 1/2014 | Cohen | A47C 27/081 5/639 |
| 2014/0310877 | A1 | 10/2014 | Sternlight et al. | |
| 2016/0302596 | A1 | 10/2016 | Ross et al. | |
| 2018/0310731 | A1* | 11/2018 | Staton | A47G 9/0253 |
| 2020/0077819 | A1* | 3/2020 | Thibodeau | A47G 9/0207 |
| 2020/0128980 | A1* | 4/2020 | Hanifi | A47G 9/1081 |
| 2022/0133045 | A1* | 5/2022 | Stavole | A47C 7/383 5/636 |

OTHER PUBLICATIONS

USPTO acting as International Searching Authority, "International Search Report and Written Opinion" for International Application No. PCT/US2022/027640, Aug. 23, 2022.

* cited by examiner

MULTI-PURPOSE INFINITY TRAVEL PILLOW

CROSS-REFERENCE TO RELATED APPLICATIONS

This application claims priority to U.S. Provisional Patent Application No. 63/183,962 entitled MULTI-PURPOSE INFINITY TRAVEL PILLOW filed May 4, 2021, which is incorporated herein by reference in its entirety.

TECHNICAL FIELD

This disclosure relates generally to stand-alone rests or supports for feet, legs, arms, back or head. More specifically, this disclosure relates to a travel pillow that may serve multiple purposes, such as a neck support, a scarf, a standard pillow, a neck travel pillow, a blanket, etc.

BACKGROUND

Travel pillows are well known for helping people rest or sleep when in a seated position. Commonly, individuals, or users, utilize a U-shaped pillow that covers the back and sides of the neck. Some travel pillows suffer from common drawbacks such as being bulky, trapping heat and moisture between the pillow and the user's neck and head, and generally being unable to adequately or comfortably support the user's head. Additionally, many of the U-shaped travel pillows push a user's head into a forward position because of the bulk of the pillow at the back of the head or neck. Furthermore, travel pillows may not offer enough versatility in their configurations to accommodate all the various positions a traveler may wish to rest in.

Another issue while traveling is often the temperature of the traveler. Many times a plane can be a cold place for many travelers and blankets are being offered less frequently than they used to. Carrying a blanket is not often practical because of their weight and size.

The following description provides the ability to overcome the shortcomings of current travel accessories and more specifically travel pillows and travel neck support systems.

SUMMARY

This disclosure relates to a travel pillow system which may comprise an outer sleeve having a first end and a second end, the first end may be reversibly connectable to the second end such that the outer sleeve has a first, open configuration in which the first end is not connected to the second end, and a second, closed configuration in which the first end is connected to the second end to form a contiguous loop from the first end to the second end; a pocket may attach to the outer sleeve, the pocket may hold a polygonal pillowcase; and a blanket, the blanket may be used for (a) selectively inserting into the outer sleeve to form at least one of an oblong pillow when the outer sleeve is in the first, open configuration and an infinity pillow when the outer sleeve is in the second, closed configuration; (b) selectively inserting into the polygonal pillowcase to form a polygonal pillow, and (c) selectively placing around a user, the blanket comprising one or more closures for selectively securing the blanket around a user, and the blanket further comprising one or more pockets for a user to insert their hands.

According to another aspect, the travel pillow system may comprise the pillowcase, which may be rectangular. The pillowcase may comprise a first pocket for selectively inserting the blanket to fill the rectangular pillowcase, and wherein the rectangular pillowcase further comprises a second pocket for storage.

In some configurations, the first end of the outer sleeve is reversibly connectable to the second end of the outer sleeve via a fastener. The outer sleeve may be formed of a breathable material. For example, the outer sleeve may be formed of a material comprising bamboo.

According to another aspect, a pillow system is disclosed, and may comprise: an outer sleeve having a first end and a second end, the first end reversibly connectable to the second end such that the outer sleeve has a first, open configuration in which the first end is not connected to the second end, and a second, closed configuration in which the first end is connected to the second end; and a blanket, the blanket having a first configuration wherein the blanket is selectively inserted into the outer sleeve to form an infinity pillow, and a second configuration wherein the blanket is selectively used as a blanket. When the first end of the outer sleeve is connected to the second end of the outer sleeve, the outer sleeve may form a contiguous loop from the first end to the second end.

In some configurations, the pillow system may further comprise a pocket attached to the outer sleeve, the pocket for holding a pillowcase; and a pillowcase in the pocket attached to the outer sleeve. The blanket may have a third configuration wherein the blanket is selectively inserted into the pillowcase to form a pillow. The pillowcase may be any suitable shape and in some configurations, the pillowcase is rectangular. The pillowcase may comprise a first pocket for selectively inserting the blanket to fill the pillowcase, and a second pocket for storage.

According to another aspect, the blanket comprises one or more closures for selectively securing the blanket around a user. Wherein the one or more closures may connect a first end of the blanket to a second end of the blanket when within the outer sleeve. The blanket may also include one or more pockets for a user to insert their hands.

According to yet another aspect, a method of using a travel pillow is disclosed. The method may comprise: selecting an outer sleeve, the outer sleeve having a first end and a second end, the first end reversibly connectable to the second end such that the outer sleeve has a first, open configuration in which the first end is not connected to the second end, and a second, closed configuration in which the first end is connected to the second end; configuring the outer sleeve into the first, open configuration; selecting a blanket, the blanket comprising one or more closures for selectively securing the blanket around a user; inserting the blanket into the outer sleeve; and connecting the first end of the outer sleeve to the second end of the outer sleeve to form a pillow. The pillow formed may be an infinity pillow.

According to another aspect, the outer sleeve further comprises a pocket and a pillowcase provided in the pocket, and the method may further comprise removing the blanket from the outer sleeve and inserting the blanket into the pillowcase.

The method may also comprise removing the blanket from the outer sleeve and placing the blanket around a user, the blanket comprising at least one closure for selectively securing the blanket around a user, and the blanket further comprising one or more pockets for a user to insert their hands.

DESCRIPTION

The following description sets forth the system and use of a pillow for neck, shoulder, arm, and back support. The pillow system also includes a blanket that may be used to stuff or fill an oblong infinity pillow, to stuff or fill a rectangular pillowcase, or used separately to provide warmth to a user. The disclosure generally refers to the pillow system as being used for travel, but it will be appreciated that the pillow system may be used in any type of setting, including at home, camping, or the like.

Figure 1:
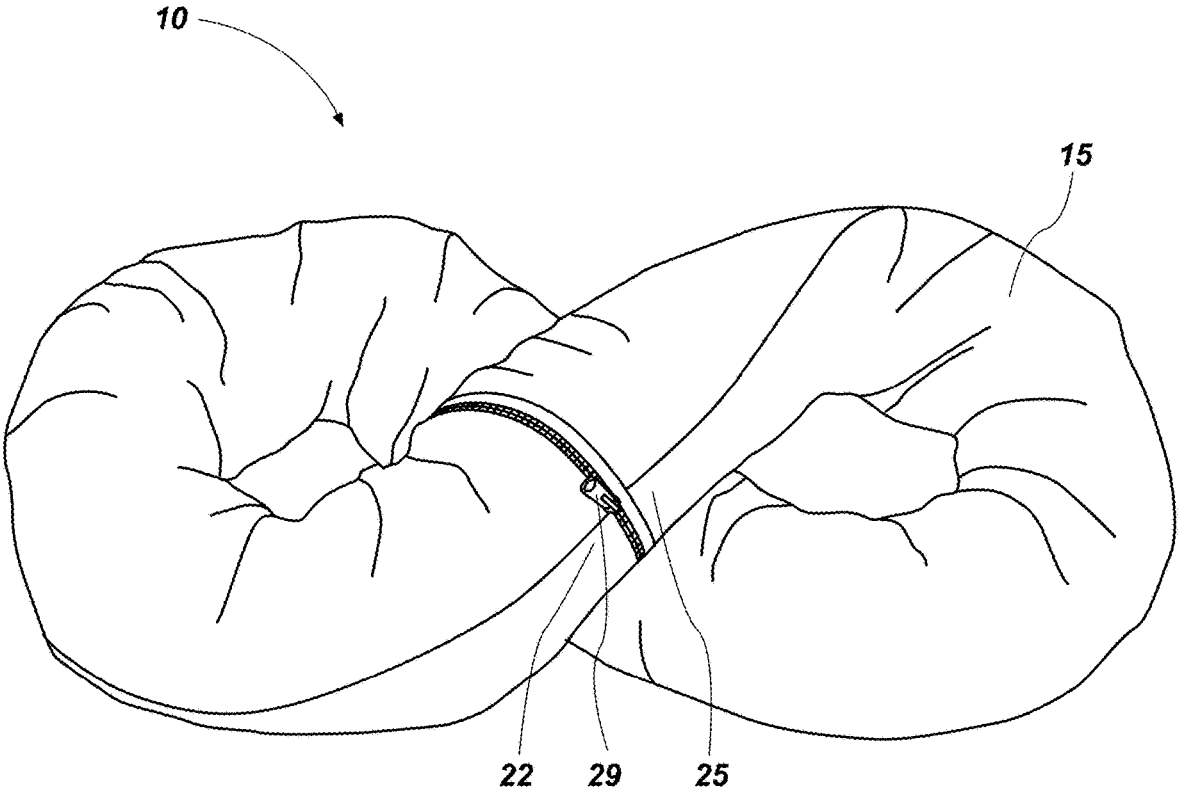
FIG. 1 illustrates a perspective view of a pillow system described herein.
Figure 2:
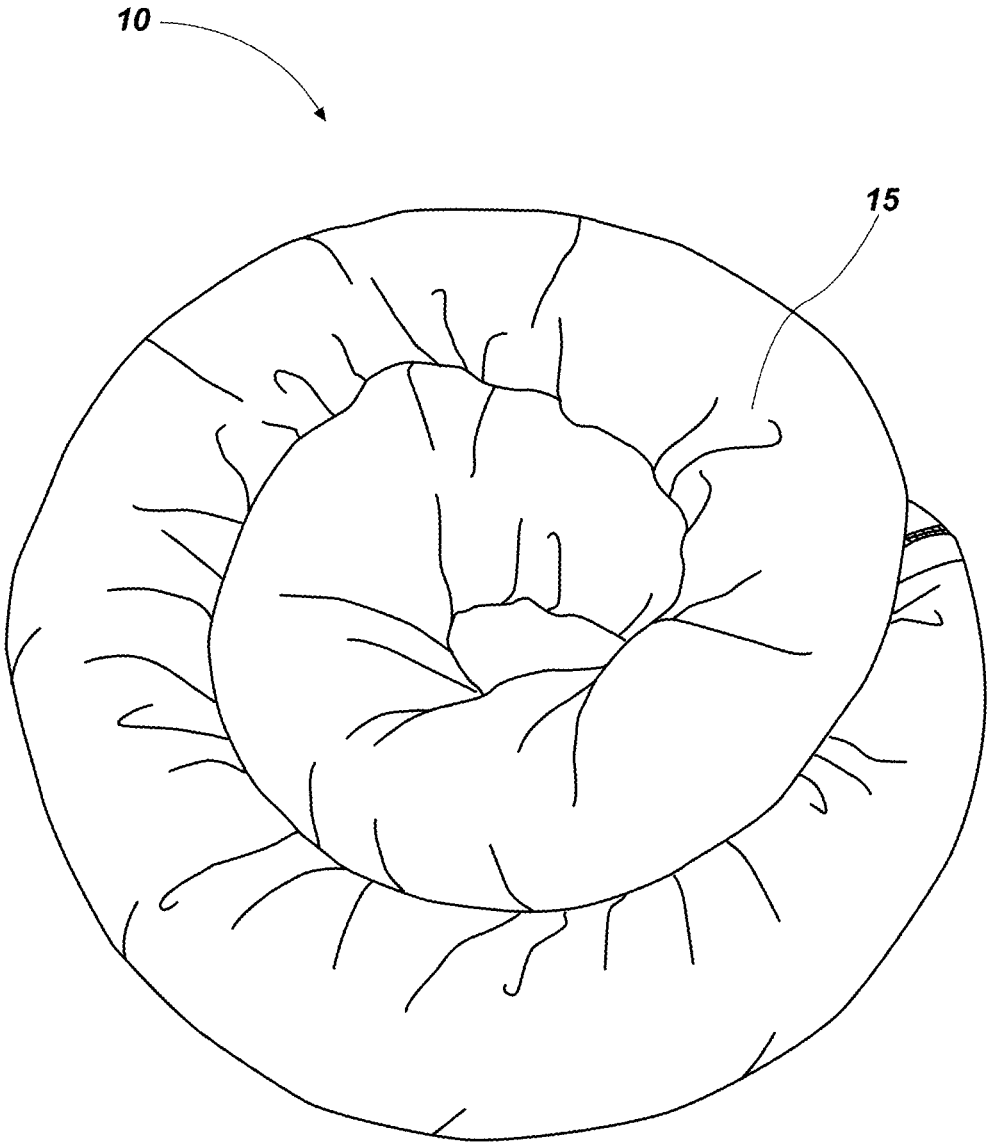
FIG. 2 illustrates a perspective view of a pillow system described herein in another configuration.
Figure 3:
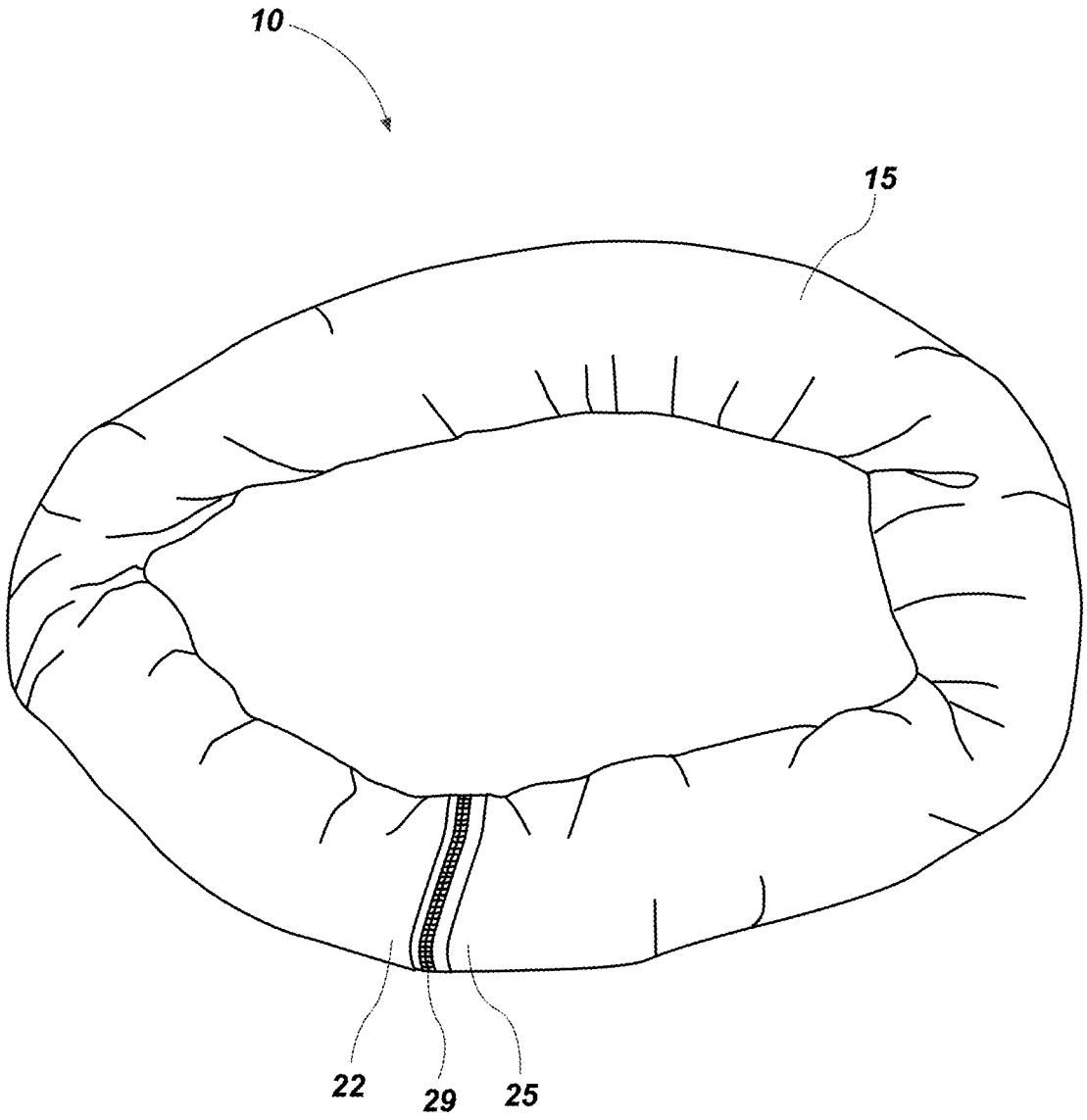
FIG. 3 illustrates a perspective view of a pillow system described herein in yet another configuration.

FIGS. 1-3 illustrate a pillow system 10 according to the present disclosure. The pillow may generally include an outer sleeve 15, with a blanket 20 used to fill or stuff the outer sleeve 15 (see FIG. 4). When the outer sleeve 15 is filled with the blanket 20, the pillow system 10 may be formed in a variety of configurations as shown, in a non-limiting fashion, in FIGS. 1-3 as well as FIGS. 11-14. It will be appreciated that there are an infinite number of configurations for the pillow system 10.

The outer sleeve 15 may be generally oblong and when filled with the blanket 20, or other fill, may be generally tubular. For example, the outer sleeve 15 may be from around 152 centimeters to around 254 centimeters long (60-100 inches), or from around 178 centimeters to around 229 centimeters long (70-90 inches). In one specific configuration, the outer sleeve 15 is about 198 centimeters (78 inches) in length, but any suitable length may be used. Similarly, any suitable width or thickness may be used, such as from about 12 centimeters to about 25 centimeters (about 5-10 inches). In one specific configuration, the outer sleeve 15 is about 15 centimeters thick (6 inches). In other configurations, the outer sleeve 15 may have different dimension and thus a different overall shape. Longer, shorter, smaller, and larger configurations are all contemplated for this disclosure for use in children as well to larger individuals.

The outer sleeve 15 may be formed from any suitable material desired. For example, cotton, cotton-blends, bamboo fabric, bamboo-blends, bamboo-synthetic blends, nylons, etc. may be used. Breathable fabrics such as bamboo and/or bamboo blends may be more comfortable in settings that a user may become overheated and in one specific configuration, a bamboo-synthetic blend may be used to form the outer sleeve 15 for breathability. Other breathable fabrics that admit air to the skin and/or allow sweat to evaporate may also be used. It will be appreciated that the outer sleeve 15 may be sewn or formed from a single piece of material, or from multiple pieces of material sewn or formed together. If multiple pieces of material or fabric are used and sewn or formed together the sewing may be generally linear from one end of the sleeve 15 to the other, or opposing end. It will also be appreciated that welding, gluing, or other means to adhere fabric is contemplated herein.

Figure 4:
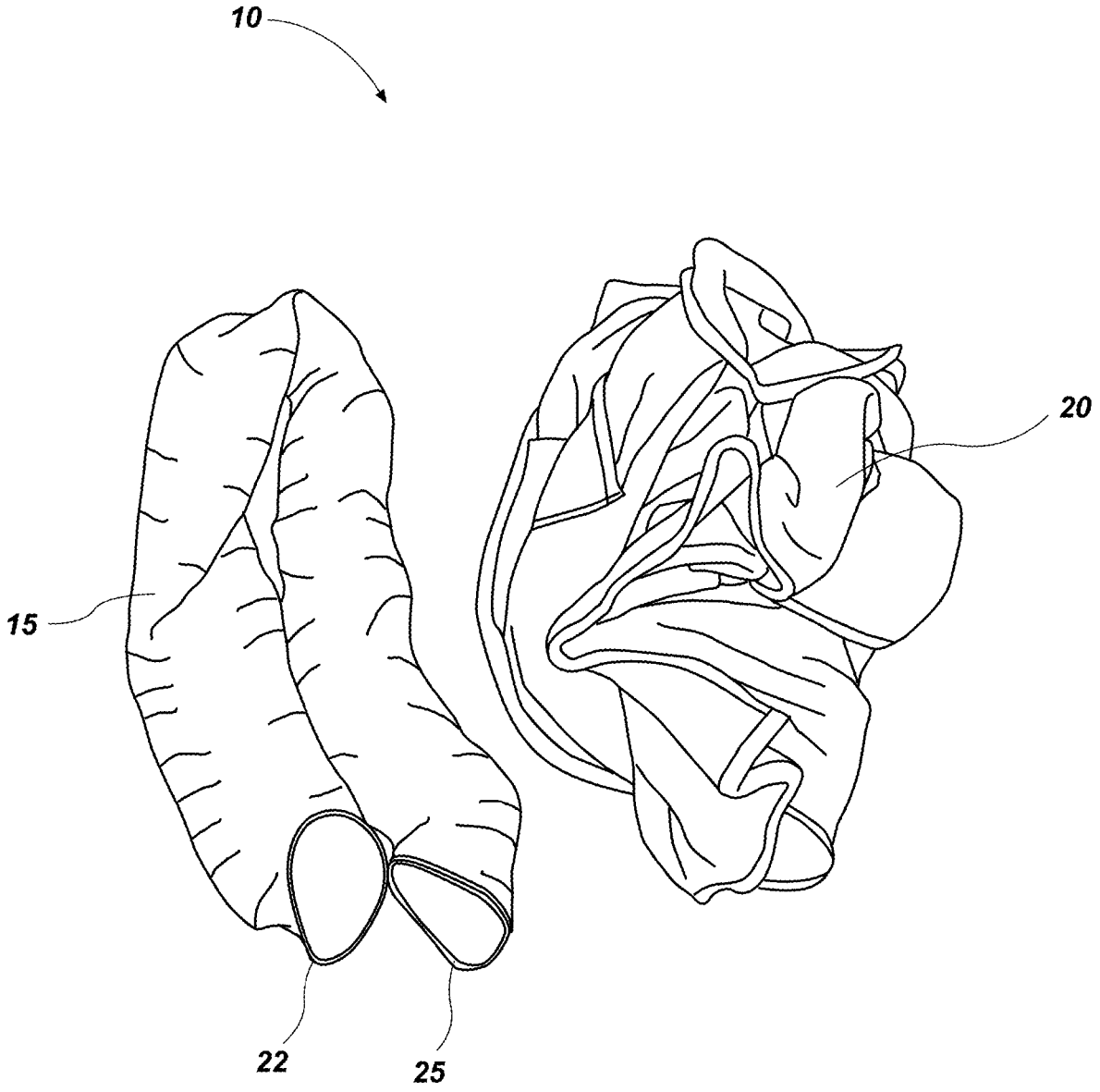
FIG. 4 illustrates a perspective view of a pillow system described herein with the blanket of the pillow system separated from the outer sleeve.
Figure 5:
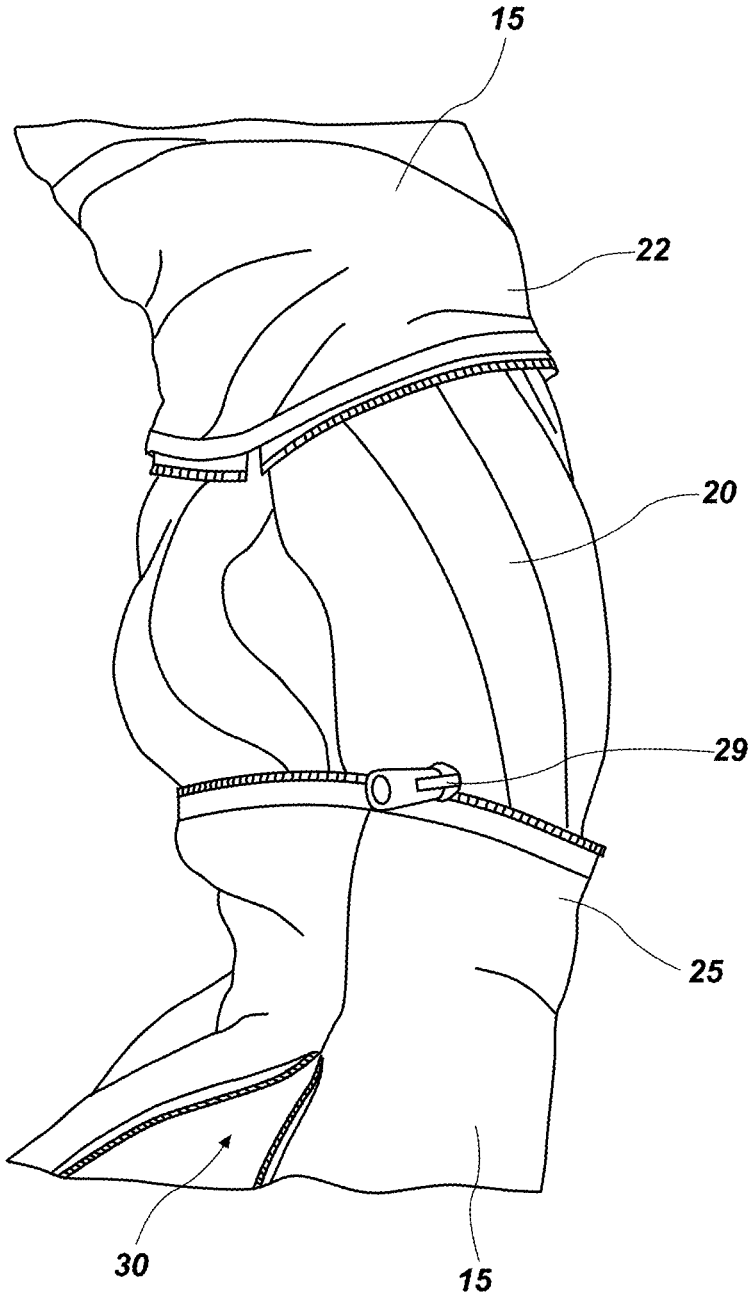
FIG. 5 is a detailed perspective view of the outer sleeve of the pillow system being separated, with the blanket seen being pulled out of the outer sleeve.
Figure 6:
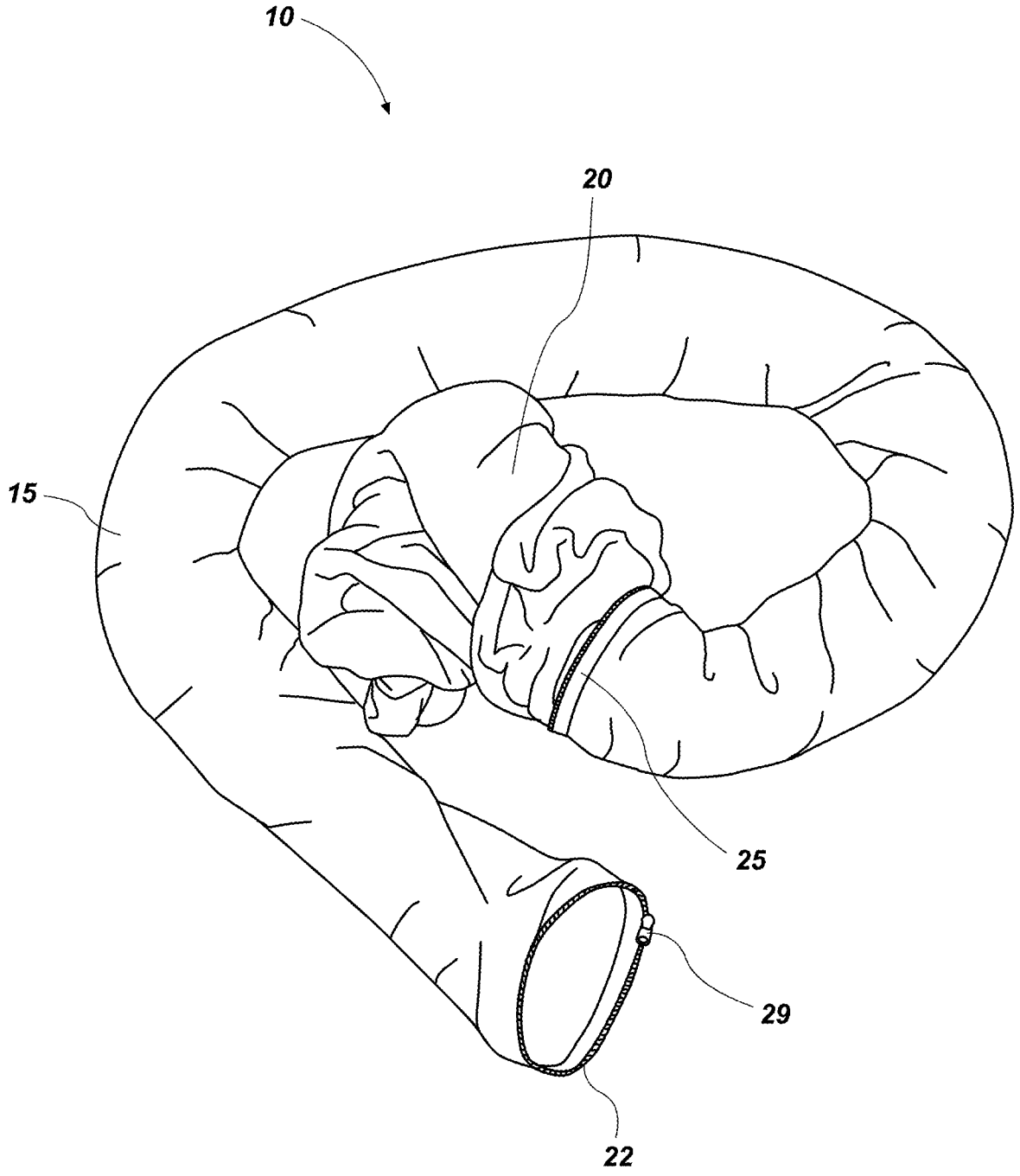
FIG. 6 is a perspective view of the outer sleeve of the pillow system in an open configuration, with the blanket seen being pulled out of the outer sleeve.

The outer sleeve 15 may have a first end 22 and a second end 25 (see also FIG. 4-6). In some configurations, each of first end 22 and second end 25 may be entirely open, substantially open, or partially open. In other configurations, one of the first end 22 and second 25 may be substantially open with the other end substantially closed. In the specific configuration illustrated in FIG. 4, each of the first end 22 and second end 25 are open. The outer sleeve 15 in this configuration may thus be described as open-ended. An open-ended outer sleeve 15 may make insertion and removal of the blanket 20 into and out of the outer sleeve 15 easier. For example, to insert the blanket 20 into an open-ended outer sleeve 15, a user may insert one end of the blanket 20 into the first end 22 of the outer sleeve 15, and then pull the blanket 20 through from the second end 25 of the outer sleeve 15. In configurations with one or more of the first end 22 and second end 25 closed, the blanket 20 may still be inserted into the outer sleeve 15.

The first end 22 and second end 25 of the outer sleeve 15 may be reversibly connected to each other with a fastener or a plurality of fasteners. For example, a zipper (zipper 29 in FIG. 5), buttons, snaps, magnets, hook and loop fastener, or any other suitable connectors or combination of connectors may be used to reversibly connect the first end 22 and the second end 25. With reversibly connectable ends, the outer sleeve 15 may have two configurations: a first, open configuration (FIG. 4) in which the first end 22 is not connected to the second end 25; and a second, closed configuration (FIGS. 1-3) in which the first end 22 is connected to the second end 25 to form a contiguous or substantially contiguous loop. Pillows that form a loop are typically referred to as infinity pillows. When the blanket 20 is positioned within the outer sleeve each end of the blanket 20 may be fastened together with closures (described further herein with relation to the blanket 20) such that the blanket is in one contiguous loop within the outer sleeve 15.

The closed formation of the pillow system 10, with the blanket 20 filling the outer sleeve 15, may have numerous, interchangeable positions. For example, the pillow system 10 may be worn looped once around the neck as a long scarf, looped twice around the neck as a head support pillow when resting in an upright or upright seated position, etc. The various configurations and applications are described in more detail herein.

In some configurations, the outer sleeve 15 may be provided with one or more pockets. Pockets may be convenient, especially when traveling, to carry items such as identification cards, credit cards, a mobile device, headphones, etc. For example, when the pillow system 10 is worn as a scarf, a pocket may hold keys, a mobile device, or credit cards to keep necessities accessible and also keep the user's hands free. Pocket(s) may be provided with one or more dividers as desired to keep items organized. In some configuration, the outer sleeve 15 may be provided with one pocket, two pockets, or three or more pockets as desired. In other configurations, pockets may not be provided. The pockets may be formed of any suitable material desired, and in some configurations, RFID-blocking fabric or material may be used. In other configurations, other materials may be used. Pockets may be formed integral to the outer sleeve 15, or may be attached to the outside of the outer sleeve 15.

Figure 7:
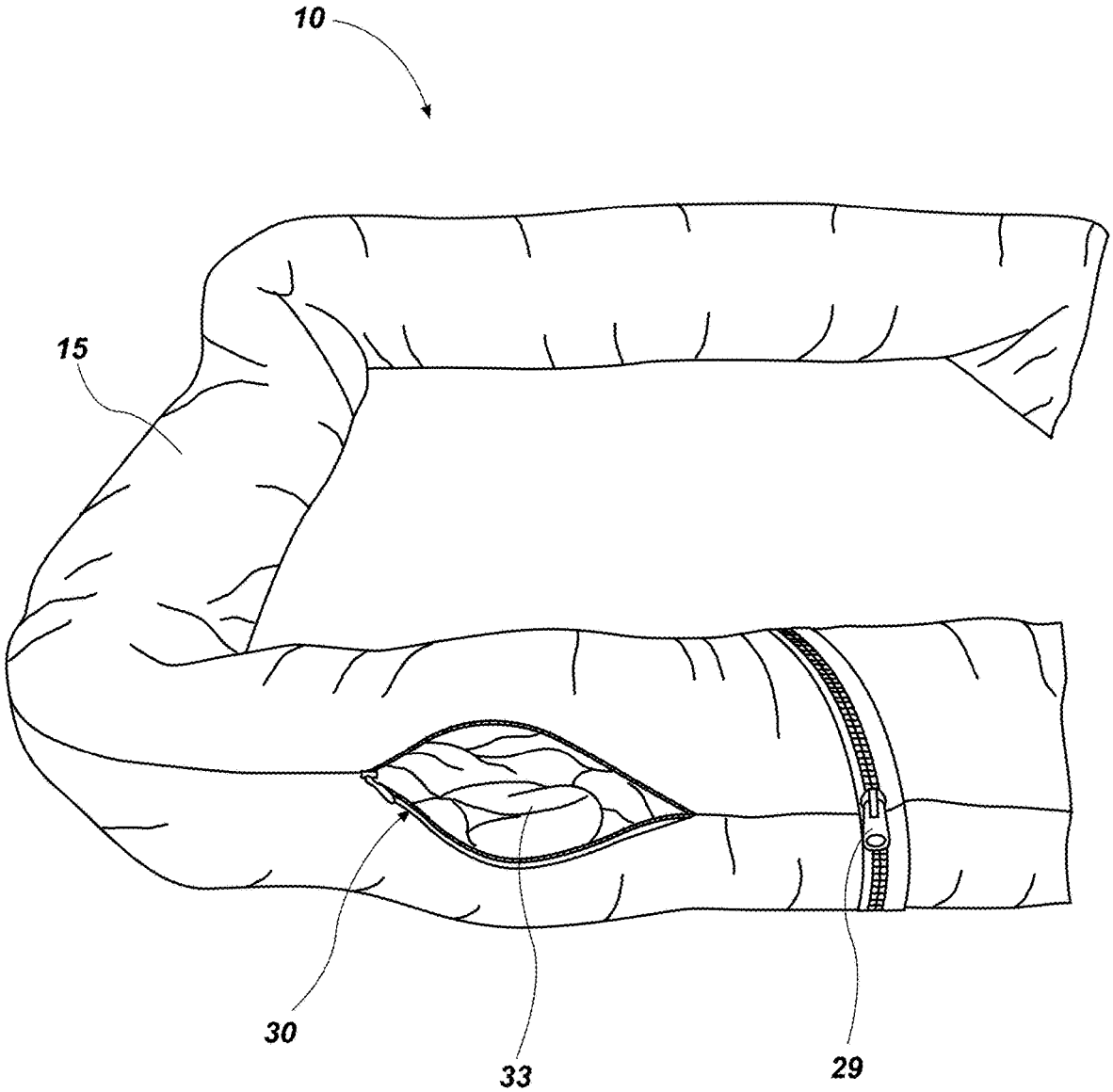
FIG. 7 is a perspective view of the pillow system showing a configuration with a pocket in the outer sleeve.
Figure 8:
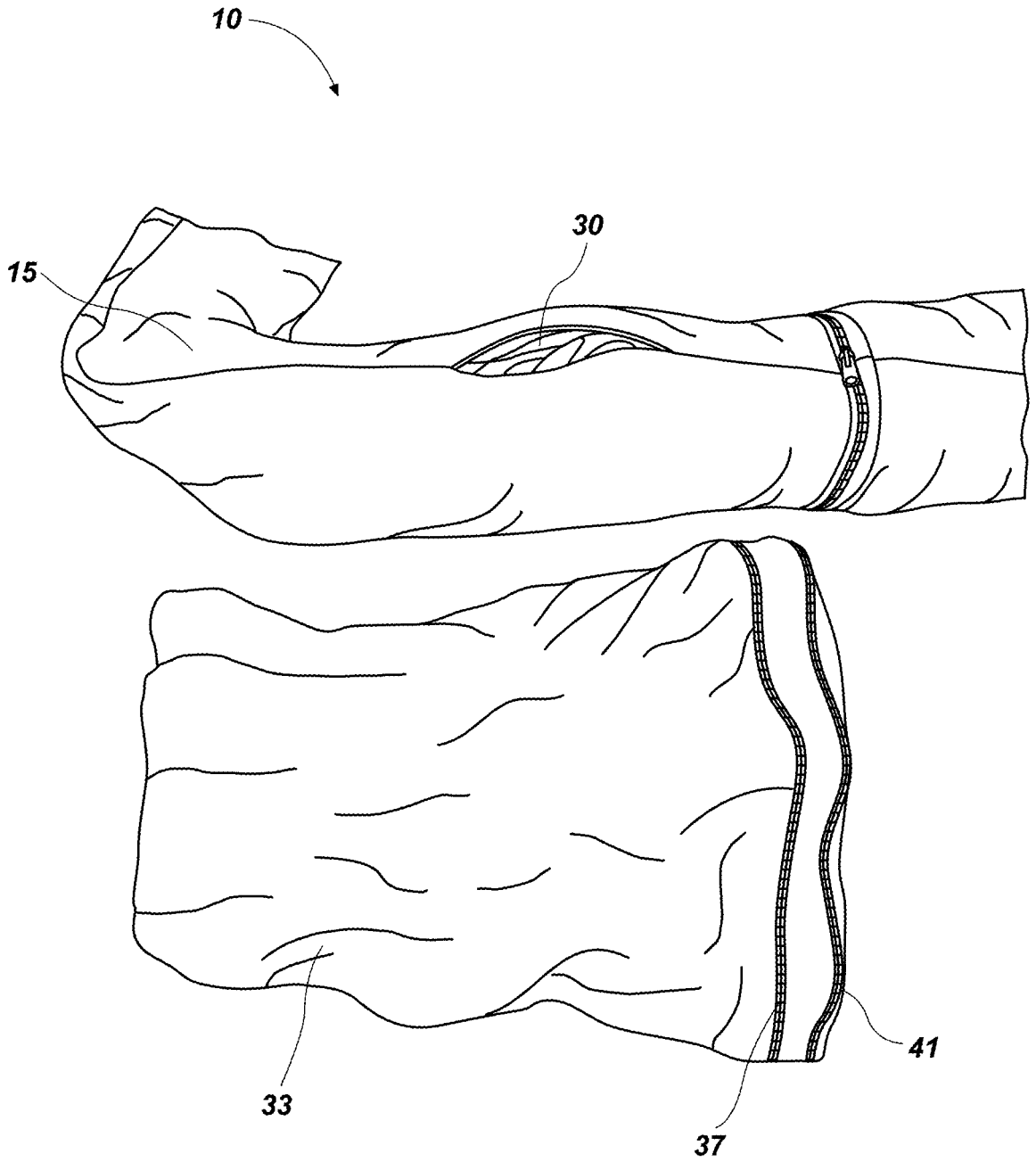
FIG. 8 shows the pillow system of FIG. 7, with the pillowcase in the pocket of the outer sleeve removed from the outer sleeve.

In one specific configuration, the outer sleeve 15 is provided with a pocket 30 which may be specifically configured to hold a pillowcase 33 (FIG. 7). The pillow system 10 may include a pillowcase 33, or a pillowcase may be provided by the user. In other configurations, the pillow system 10 may not include a pillowcase 33. The pillowcase 33 may be any shape and size desired. For example, a standard pillowcase may be used, or a smaller, travel-sized pillowcase may be used. The pillowcase 33 may also be any desired shape. In the configuration shown in FIG. 8, the pillowcase 33 is rectangular, but other shapes such as circular, oval, etc., or any polygonal shape may be used as desired. It will be appreciated that different shapes and sizes of the pillowcase 33 are considered and contemplated herein. The pillowcase may be formed from any suitable material. For example, cotton, cotton-blends, bamboo fabric, bamboo-blends, bamboo-synthetic blends, etc. may be used. Breathable fabrics such as bamboo and/or bamboo blends may be more comfortable in settings that a user may become overheated. The pillowcase 33 may be the same material as the outer sleeve 15 or different material.

The pillowcase 33 may also be provided with additional features for convenience during use and/or for convenience while traveling. For example, the pillowcase 33 may have a first, larger, pocket 41 for receiving the blanket 20 to stuff or fill the pillowcase 33 (the outer sleeve 15 may also be used to stuff or fill pillowcase 33 as desired). The pillowcase 33 may also have a second, separate, pocket 37 for storing items such as a mobile device, headphones, identification, etc. Each pocket 37, 41 may be formed of any suitable material and in some cases, RFID-blocking fabric or material may be used to form the first pocket 41 or second pocket 37. The first pocket 41 and second pocket 37 may also include one or more divides, or a separation sheet, as desired to organize and store items. The first pocket 41 and second pocket 37 may be adjacent in a planar fashion. Each pocket 37, 41 may be open or selectively closeable utilizing zippers, buttons, snaps, hook and look closures, or the like. Additionally, the pillowcase 33 may include a foldable "flap" fixed to three sides of the pillow case 33 configured such that the flap folds over one or both of the pockets 37, 41. While two pockets are readily apparent in the figures, it will be appreciated that additional pockets in a variety of configurations is contemplated herein and each may divided from the others therein.

In configurations where a pillowcase 33 is provided, a user may easily access the pillowcase 33 from the pocket 30 of the outer sleeve 15. And by detaching the first end 22 from the second end 25 of the outer sleeve 15, the blanket 20 may be removed from the outer sleeve 15 and stuffed into the pillowcase 33. The outer sleeve 15 may similarly be stuffed into the pillowcase 33, in either the first pocket 41 or second pocket 37, or stored in another location. Small personal items may further be stored in either the first pocket 41 or the second pocket 37 of the pillowcase 33 for convenience.

Figure 9:
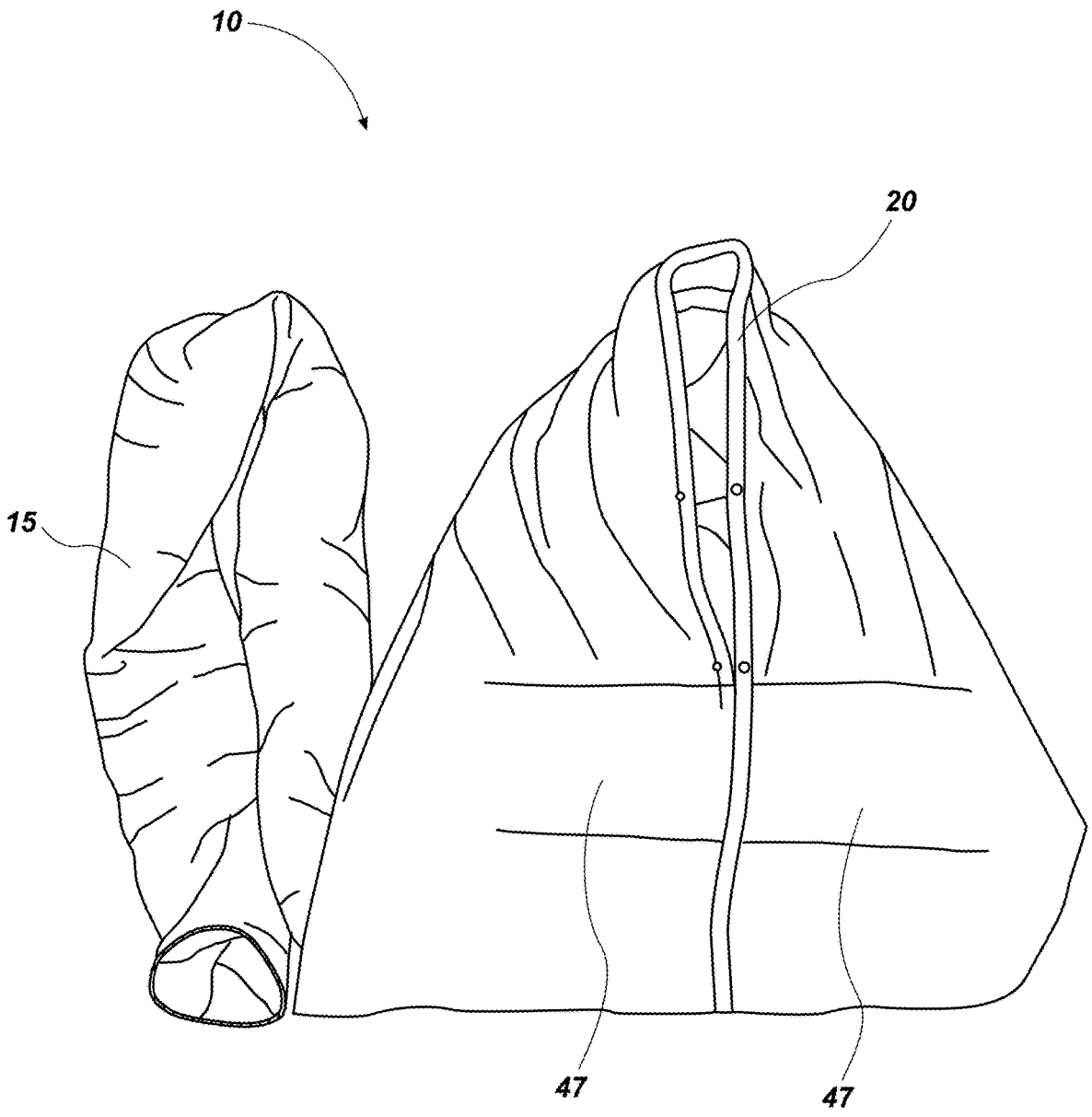
FIG. 9 is a perspective view of a pillow system described herein, showing the blanket separated from the outer sleeve.
Figure 10:
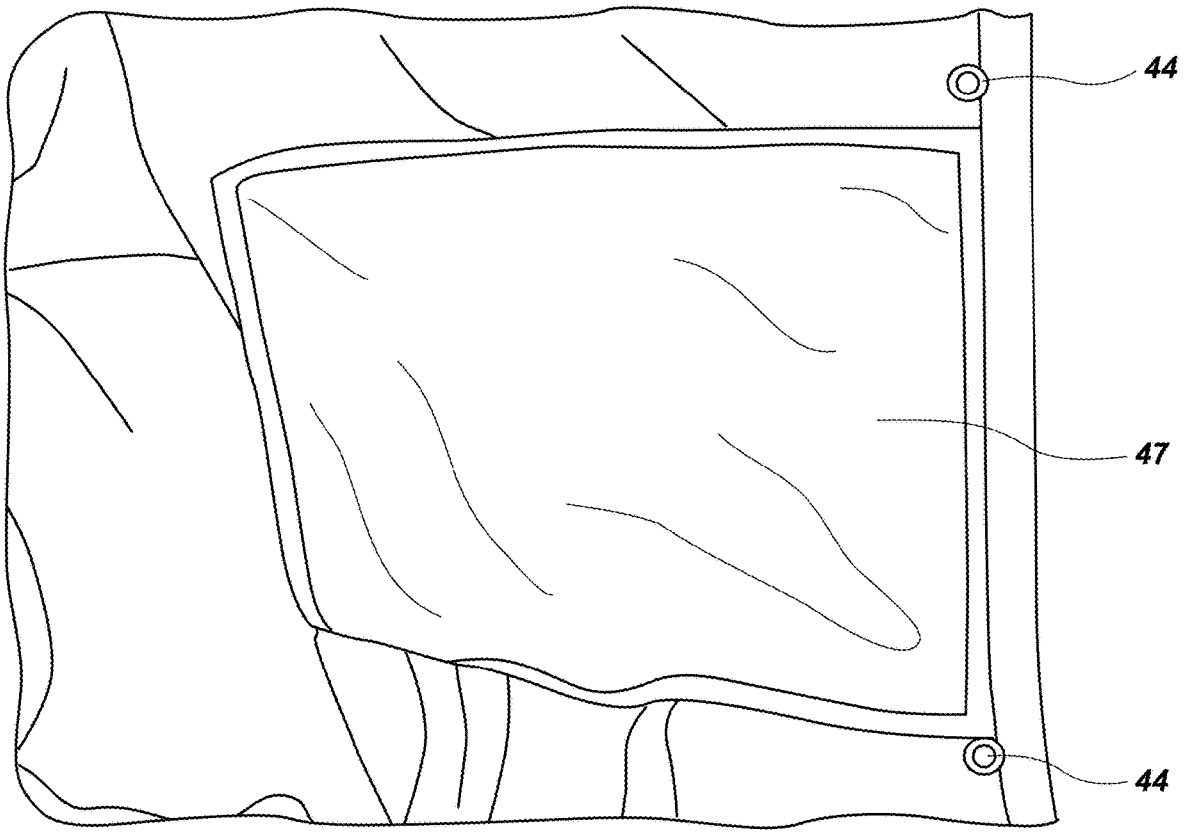
FIG. 10 is a detailed perspective view of the blanket of FIG. 9, showing hand-pockets and closures provided on the blanket.

According to another aspect, the blanket 20 which may be used to stuff or fill the outer sleeve 15 and/or pillowcase 33, may also be used as a wearable blanket or shawl. For example, blanket 20 may be provided with one or more features for selectively connecting the blanket 20 around a user. Any type of closure may be used, such as buttons, snaps, snap-fasteners, magnets, hook-and-eye, hook and loop, etc. In the exemplary configuration shown in FIGS. 9-10, buttons 44 are provided to allow a user to put the blanket 20 around themselves like a shawl and secure the blanket 20 in place. The blanket may be secured in place over the user's shoulders, or may be put over the user's head like a hood.

The blanket 20 may also be provided with one or more pockets 47 for a user to place their hands in while wearing the blanket 20 as a shawl or hood. In some configurations, the blanket 20 may be worn with the pockets 47 facing inwardly towards the user so that a user may keep their hands and arms inside the blanket 20 and place their hands in the pockets 47 while wearing the blanket 20. In other configurations, the pockets 47 may face outwardly.

Figure 11:
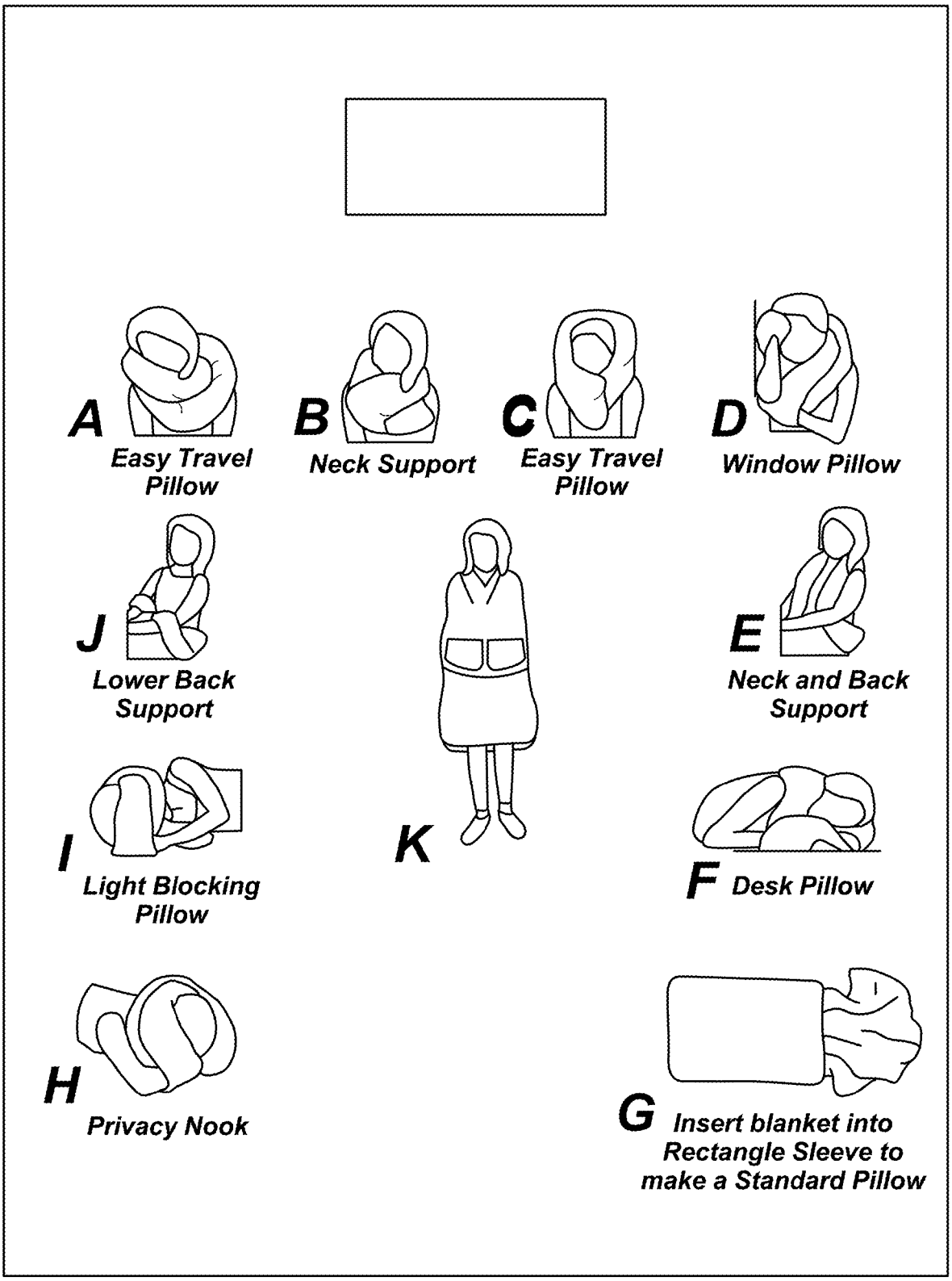
FIG. 11A-K is a schematic of various configurations of the pillow system described herein.
Figure 12:
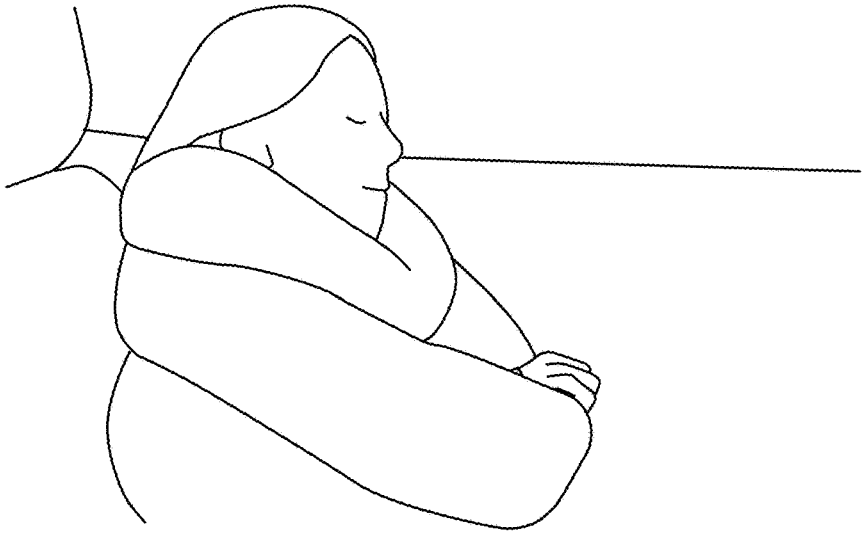
FIG. 12 is a perspective view of an exemplary use of the pillow system described herein.
Figure 13:
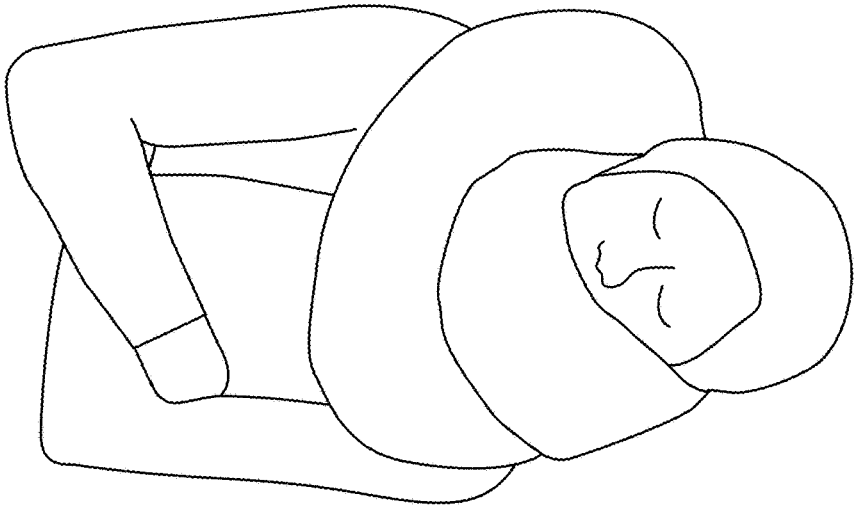
FIG. 13 is a perspective view of another exemplary use of the pillow system described herein.
Figure 14:
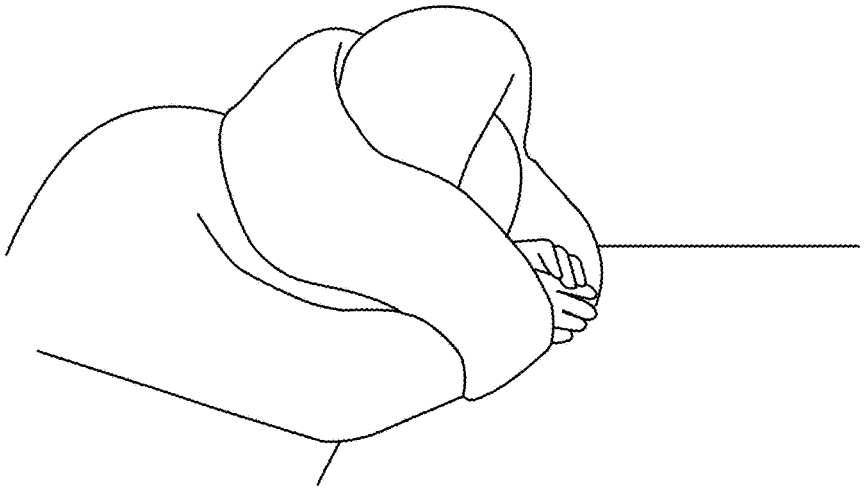
FIG. 14 is a perspective view of an exemplary use of the pillow system described herein.

In use, the pillow system 10 may be changed to various configurations depending on the needs of the user. FIGS. 11-14 show exemplary uses of the pillow system 10. In FIG. 11, starting from the top left and moving clockwise, the following uses are shown: (A) as a travel pillow, typically wrapped twice around a user's head to support the head and neck while sleeping and/or resting in a substantially upright seated position; (B) as a neck support, wrapped once or twice around a user's neck, while going about daily activities; (C) as a noise blocking pillow, wrapped once or twice around a user's head including the ears to block out environmental sounds; (D) as a window pillow, wrapped around the user's head and arms to support a user while sleeping and/or resting in a substantially upright seated position against a window; (E) as a neck and back support, wrapped around a user's neck and lower back while the user is in a seated position; (F) as a desk pillow, wrapped around a user's neck and hands to support a user resting their head on a desk or table while in a seated position; (G) as a standard pillow, with the blanket 20 stuffed into a rectangular pillowcase 33, such as a pillowcase provided within the outer sleeve or a pillowcase selected by the user; (H) as a privacy nook, with the pillow wrapped once or twice around the user's head; (I) as a light-blocking pillow, with the pillow wrapped once or twice around the user's head and particularly the user's eyes; (J) as a lower back support, wrapped around the user's arms and lower back while the user is in a seated position. And finally, the blanket 20 provided inside the outer sleeve 15 may be taken out and secured around a user and worn as a hood/shawl, with the option for the user to insert their hands into the provided pockets (K).

The pillow system 10 may be used during travel, such as on flights, car rides, bus rides, and train rides. The pillow system 10 may also be used to nap at work or school on a desk. The pillow system 10 may be used in various positioning options, including support for a user's chin, neck, head, hands, etc., depending on the position of the pillow system 10 used.

Although the foregoing disclosure provides many specifics, such as use of the pillow system in conjunction with travelling, it will be appreciated that other applications may be utilize, and these should not be construed as limiting the scope of any of the ensuing claims. Other embodiments and configurations may be devised which do not depart from the scopes of the claims. Features from different embodiments and configurations may be employed separately or in combination. Accordingly, all additions, deletions and modifications to the disclosed subject matter that fall within the scopes of the claims are to be embraced thereby. The scope of each claim is indicated and limited only by its plain language and the full scope of available legal equivalents to its elements. The various embodiments described above, including elements of the various embodiments described above, can be combined to provide further embodiments. Aspects of the embodiments can be modified, if necessary to employ concepts of the various patents, applications and publications to provide yet further embodiments.

What is claimed:

1. A travel pillow system comprising:

an outer sleeve having a first end and a second end, the first end reversibly connectable to the second end such that the outer sleeve has a first, open configuration in which the first end is not connected to the second end, and a second, closed configuration in which the first end is connected to the second end to form a contiguous loop from the first end to the second end;

a sleeve pocket separate from and planarly adjacent to the sleeve;

a pillowcase storable within the sleeve pocket; and a blanket, the blanket for selectively inserting into the outer sleeve to form at least one of an oblong pillow when the outer sleeve is in the first, open configuration and an infinity pillow when the outer sleeve is in the second, closed configuration;

selectively inserting into the pillowcase to form a pillow, and selectively placing around a user, the blanket comprising one or more closures for selectively securing the blanket around a user.

2. The travel pillow system of claim 1, wherein the pillowcase comprises a first pocket for selectively inserting the blanket to fill the pillowcase, and wherein the pillowcase further comprises a second pocket.

3. The travel pillow of claim 2, wherein the first pocket and second pocket are adjacent and separated by a divide.

4. The travel pillow system of claim 1, wherein the first end of the outer sleeve is reversibly connectable to the second end of the outer sleeve via a fastener.

5. The travel pillow system of claim 1, wherein the outer sleeve is formed of a material that admits air to the skin and/or allows sweat to evaporate.

6. The travel pillow system of claim 1, wherein the blanket further comprises one or more pockets for a user's hands.

7. A pillow system comprising:

an outer sleeve having a first end and a second end, the first end reversibly connectable to the second end such that the outer sleeve has a first, open configuration in which the first end is not connected to the second end, and a second, closed configuration in which the first end is connected to the second end;

at least one of the first end and the second end being open ended;

a blanket, the blanket having a first configuration wherein the blanket is selectively inserted into the outer sleeve to form an infinity pillow; and a pocket separate from and planarly adjacent to the outer sleeve, the pocket integral to the outer sleeve; and a pillowcase within the pocket.

8. The pillow system of claim 7, wherein when the first end of the outer sleeve is connected to the second end of the outer sleeve, the outer sleeve forms a contiguous loop from the first end to the second end.

9. The pillow system of claim 7, wherein the blanket has a third configuration wherein the blanket is selectively inserted into the pillowcase to form a pillow.

10. The pillow system of claim 7, wherein the pillowcase is rectangular.

11. The pillow system of claim 10, wherein the pillowcase comprises a first pocket for selectively inserting the blanket to fill the pillowcase, and wherein the pillowcase further comprises a second pocket for storage.

12. The pillow system of claim 7, wherein the blanket comprises one or more closures for selectively securing the blanket around a user.

13. The pillow system of claim 12, wherein the blanket further comprises one or more pockets for a user to insert the user's hands.

14. A method of using a travel pillow, the method comprising:

selecting an outer sleeve, the outer sleeve having a first end and a second end, the first end reversibly connectable to the second end such that the outer sleeve has a first, open configuration in which the first end is not connected to the second end, and a second, closed configuration in which the first end is connected to the second end;

configuring the outer sleeve into the first, open configuration;

selecting a blanket, the blanket comprising one or more closures for selectively securing the blanket around a user;

inserting the blanket into the outer sleeve;

connecting the first end of the outer sleeve to the second end of the outer sleeve to form a pillow; and storing a pillowcase in a pocket separate from and planarly adjacent to the outer sleeve, the pocket attached to the outer sleeve.

15. The method of using the travel pillow of claim 14, wherein the step of connecting the first end of the outer sleeve to the second end of the outer sleeve to form a pillow comprises forming an infinity pillow.

16. The method of using the travel pillow of claim 14, wherein the method further comprises removing the blanket from the outer sleeve and the pillowcase from the pocket and inserting the blanket into the pillowcase.

17. The method of using the travel pillow of claim 14, wherein the method further comprises removing the blanket from the outer sleeve and placing the blanket around a user, and the blanket further comprising one or more pockets for a user to insert the user's hands.

* * * * *